US006568221B2

(12) United States Patent
Seeger et al.

(10) Patent No.: US 6,568,221 B2
(45) Date of Patent: May 27, 2003

(54) CIRCULAR KNITTING MACHINE

(75) Inventors: Stefan Seeger, Jungingen (DE); Dietmar Traenkle, Balingen (DE)

(73) Assignee: SIPRA Patententwicklungs- und Beteiligungsgesellschatt mbH, Albstadt (DE)

( * ) Notice: Subject to any disclaimer, the term of this patent is extended or adjusted under 35 U.S.C. 154(b) by 0 days.

(21) Appl. No.: 10/128,814

(22) Filed: Apr. 23, 2002

(65) Prior Publication Data

US 2002/0157427 A1 Oct. 31, 2002

(30) Foreign Application Priority Data

Apr. 25, 2001 (DE) ..... 101 20 736

(51) Int. Cl.[7] ..... D04B 15/94
(52) U.S. Cl. ..... 66/8; 66/153; 66/149 R
(58) Field of Search ..... 66/8, 60 H, 147, 66/148, 149, 150, 151, 152, 153, 1 R; 242/598.1, 598.2, 598.3, 598.5

(56) References Cited

U.S. PATENT DOCUMENTS

| | | | | | |
|---|---|---|---|---|---|
| 5,042,272 | A | * | 8/1991 | Furr | 66/151 |
| 5,157,948 | A | * | 10/1992 | Rikiishi et al. | 66/151 |
| 5,285,663 | A | * | 2/1994 | Taniguchi | 66/153 |
| 5,566,558 | A | | 10/1996 | Tsuchiya | |
| 6,276,630 | B1 | * | 8/2001 | Mueller et al. | 66/151 |

FOREIGN PATENT DOCUMENTS

| | | |
|---|---|---|
| DE | 691 21 291 T2 | 3/1997 |
| WO | 00/50678 | 8/2000 |

* cited by examiner

*Primary Examiner*—Danny Worrell
(74) *Attorney, Agent, or Firm*—Michael J. Striker

(57) ABSTRACT

A circular knitting machine with a frame (1) having a plurality of feet (2, 3, 4), a needle carrier (7), a cam box ring and a take-down and/or winding-up device (14) mounted in the frame (1), wherein at least one of the feet (3, 4) is adjustable for altering the machine width.

12 Claims, 5 Drawing Sheets

CIRCULAR KNITTING MACHINE

BACKGROUND OF THE INVENTION

The present invention relates to a circular knitting machine.

In circular knitting machines of this kind, with needle cylinder diameters of 26" to 30" and larger for example, there is frequently the need to design the take-down and/or winding-up device such that what is wound up is not the closed hose coming from the machine but a fabric slit along one long side and then opened out to double width (DE-T2-0 691 21 291, U.S. Pat. No. 5,566,558, WO-A 00/50678). In such a case take-down and winding-up rollers are provided which have approximately twice the length which is otherwise normal and the machine diameter has in this case to become substantially greater than is generally the case with the use of needle cylinders with diameters from 26" to 30". Greater machine diameters than usual are moreover necessary when larger needle cylinder diameters of 34" for example or even up to 68" are desired for other reasons.

Circular knitting machines of the kind initially specified with such diameters involve problems with both transport and space. This is above all a consequence of the fact that their frames are provided with radially outstanding feet, which have at the smallest point a machine width of more than 3000 mm (e.g. 3600 mm) and mostly a still greater length transverse thereto, when width denotes the smallest dimension which can be measured parallel to the surface of the ground and transverse to the length or the smallest diameter of the machine, respectively. Such machines, therefore, oftenly have to be transported on a low loader with police escort. For transport on a low loader without police escort a machine width of 3000 mm at the most would be necessary and for transport on an ordinary lorry a width of 2500 mm at the most. It must also not be forgotten that the workshops both at the manufacturer and at the user mostly have doors and/or hoists with clear widths which are less than 3600 mm. Finally, there is a significant need for machines which take up the smallest amount of room and above have the smallest possible width, especially at the manufacturer's, where as a rule numerous circular knitting machines are arranged beside one another in the same workshop for later utilisation by the user.

In order to overcome these problems various solutions have been proposed by the machine manufacturers but they are all not entirely satisfactory. Thus it is known for example to remove one of the feet of the frame completely for transporting the machine and optionally to replace it by a special auxiliary foot. This either creates undesirable additional cost or impedes both transport and reconstruction, since additional wood sub-frames and/or fork lift trucks or the like are needed. It is further known to arrange the three feet present as a rule not at equal intervals of 120° but to mount two feet with substantially greater intervals relative to the third foot, so that these two feet are on the one hand in fact close together and thereby reduce the machine width but on the other hand they result in substantially reduced stability of the machine frame.

In the light of this state of the art the technical problem which is to be solved by the present invention consists in so designing the circular knitting machine of the kind initially specified that its width can be altered with comparatively cost-effective means and without substantially affecting stability.

SUMMARY OF THE INVENTION

A circular knitting machine of the invention solves this problem.

In the inventive circular knitting machine comprising a needle carrier having a central axis, a cam box ring surrounding the needle carrier, a device for taking down and/or winding up a knit wear produced by the needle carrier, and a frame for mounting the carrier, the cam box ring and the device, the frame has at least three feet establishing a machine width, and at least one of the feet is adjustable for altering the machine width.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

SUMMARY OF THE INVENTION

The invention will be explained in more detail below in conjunction with the accompanying drawings of an embodiment, in which.

DESCRIPTION OF THE PREFERRED EMBODIMENTS

Figure 1:
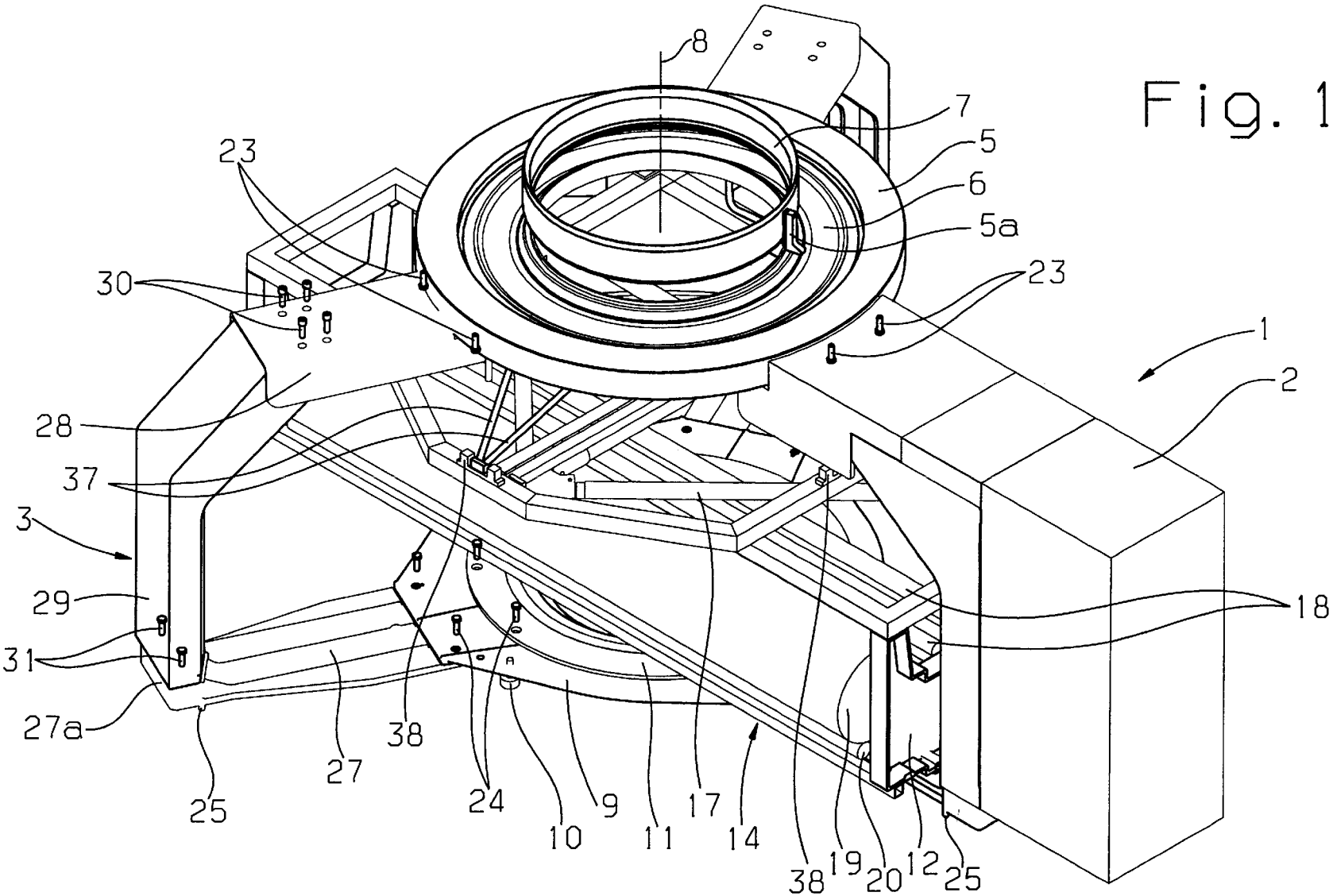
FIG. 1 is a schematic perspective view of a circular knitting machine according to the invention in an operating state.
Figure 2:
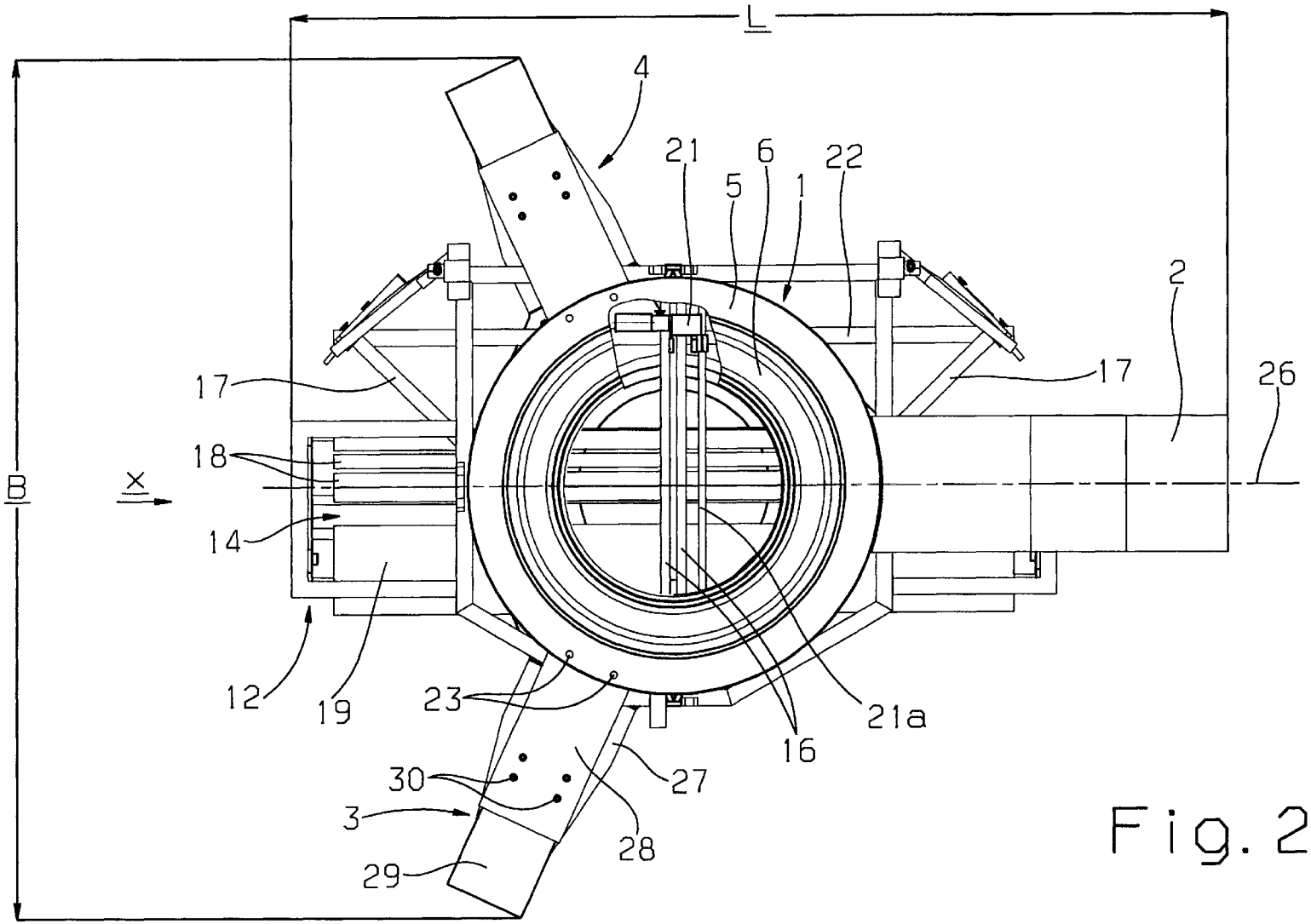
FIG. 2 is a plan view of the circular knitting machine according to FIG. 1.
Figure 3:
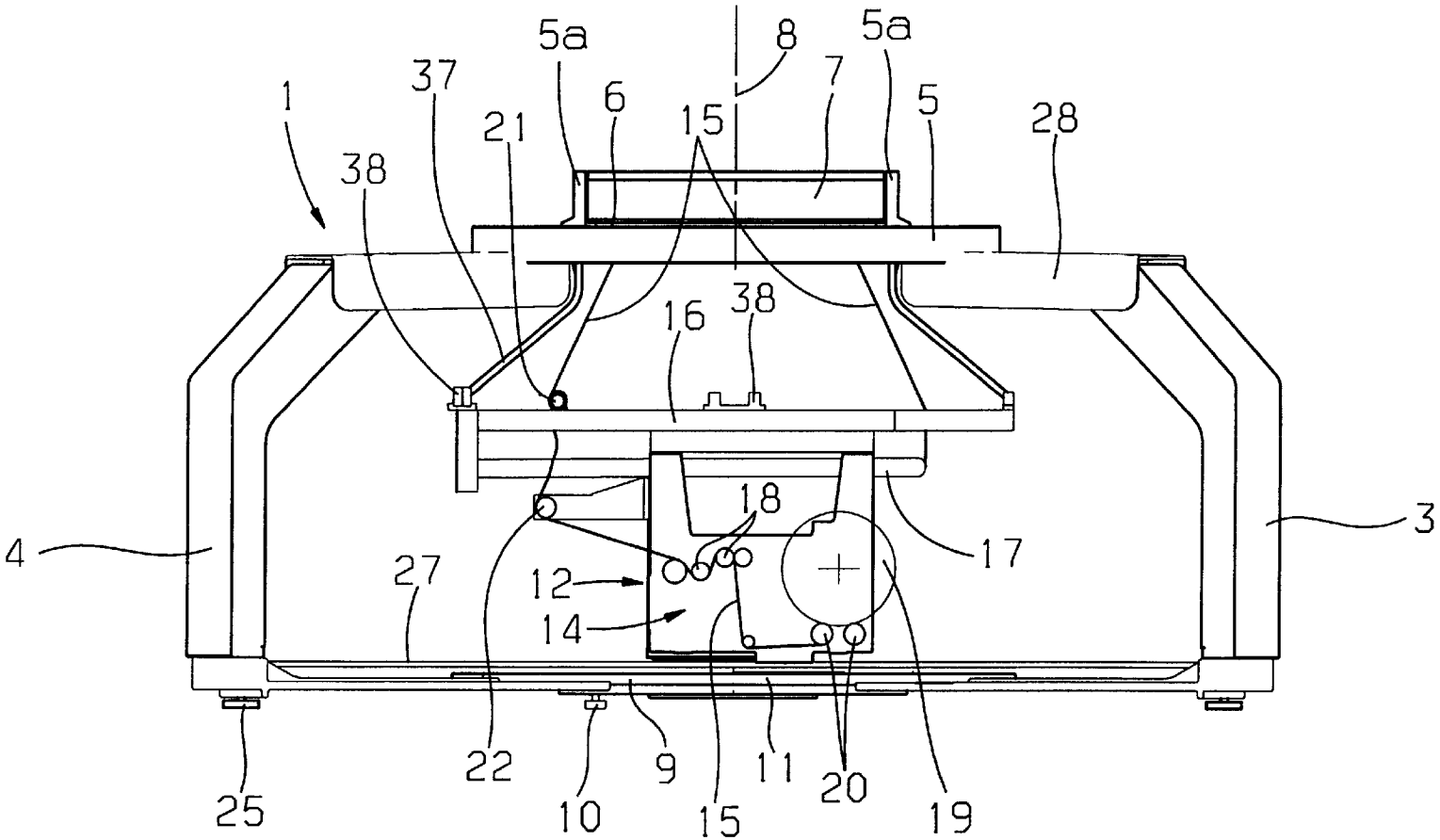
FIG. 3 is a side view of the circular knitting machine in the direction of an arrow x in FIG. 2.

According to FIGS. 1 to 3 a circular knitting machine comprises a frame 1, which has in the embodiment three feet 2 to 4 projecting radially out from the machine at angular spacings of about 120° each. The foot 2 is a main foot and each of the feet 3 and 4 is a side foot. The main foot 2 serves to receive a drive motor and other electrical and electronic assemblies, not shown in detail, as well as operating elements for the circular knitting machine, while the side feet 3, 4 are free from such installed units, apart from a switch unit optionally present.

The frame 1 further comprises an upper support ring 5, in which a cylinder support ring 6 is rotatably mounted. A needle carrier 7 in the form of a needle cylinder, only schematically indicated, is fixed on the support ring 6 and is mounted to rotate in the frame 1 together with the cylinder support ring 6 about a central axis 8 of the circular knitting machine. The support ring 5 serves inter alia to receive a customary cam box ring surrounding the needle carrier 7, only one segment 5*a* thereof being shown for simplicity. The frame 1 moreover comprises a lower support ring 9, which can be rested on the ground with the aid of rotatable auxiliary feet 10 of adjustable height fixed to its underside. The lower support ring 9 serves to rotatably support a revolving plate 11, on which is fixed a frame 12 which carries a take-down and/or winding up device generally denoted by the reference numeral 14, by means of which knitwear 15 produced by the needle carrier 7 and indicated only in FIG. 3 can be taken down and wound up. It is immaterial in principle whether the knitwear 15 is only taken down by the take-down and/or winding-up device 14, is only wound up and/or is both taken down and wound up, as is generally known to the man skilled in the art.

In the embodiment the frame 12 includes in its upper region two fixed or rotatably mounted guide bars 16, two rotatably mounted rollers 17 directly below these bars, preferably arranged substantially horizontally in a V-shape for spreading out the knitwear, and below these rollers, in a middle part of the frame 12, two or more rotary take-down rollers 18 which rotate synchronously with the rollers 17, and finally a winding-up roller 19 mounted to rotate idly in the frame 12 in a lower section. At least one drive roller 20 bearing on its periphery is associated with the roller 19, in order to wind up knitwear 15 fed from the take-down rollers 18 on the winding-up roller 19 in known manner. Finally, the circular knitting machine comprises a rotatable blade 21 (FIG. 3) mounted in the frame 1, for the purpose of cutting open the knitwear 15 coming from the needle carrier 7 along a side line, after passing a fabric stretcher, not shown, as well as the guide bars 16. The blade 21 is preferably slidably mounted on a bar 21*a,* in order to make it possible to adapt to different fabric widths. The rollers 17 can either be stationary or rotate and optionally be driven independently of the take-down rollers 18 with the aid or a separate rotary drive.

In operation of the circular knitting machine the knitwear 15 coming from the needle carrier 7 is spread out by means of the V-rollers 17 along the cut line, until it forms a single-layer, substantially flat band and is then fed with the aid of a guide roller 22 (FIGS. 2 and 3) mounted rotatably in the frame 12 to the take-down rollers 18 and thence to the winding-up roller 19. It is then wound up by this with a width corresponding to twice the width of the double layer hose produced by the needle carrier 7 and normally folded along opposite side edges. It is immaterial whether the needle carrier 7 and the whole take-down and winding-up device 14 therewith rotate about the middle axis 8, with the aid of a drive fitted in the main foot 2, or whether both stay stationary and the cam box ring is rotated instead.

The frame 1 is moreover assembled into a mechanically stable assembly by means of screws 23, which connect the upper ends of the feet 2 to 4 to the upper support ring 5, and screws 24, which connect the lower ends of the feet 2 to 4 to the lower support ring 9, this assembly absorbing all the forces and moments occurring during operation of the circular knitting machine and preferably being supported on adjustable compensating elements 25 projecting downwards from the undersides of the feet 2 to 4.

Circular knitting machines of this kind are generally known and therefore do not need to be explained to the man skilled in the art in more detail (DE-T2 691 21 291, U.S. Pat. No. 5,566,558, WO-A 00/506 78).

In accordance with the invention the frame 1 has at least one adjustable foot, by means of which the width B (FIG. 2) of the described circular knitting machine can be altered. Such an alteration is necessary for example when a door through which the circular knitting machine has to be transported has a clear width which is smaller than the smallest dimension of the circular knitting machine measured parallel to the ground. In the same way, the required width of a load area of a lorry or the like depends on the smallest width of the circular knitting machine in any direction, while the length measured parallel thereto usually does not matter. In order to explain the invention, the width B of a circular knitting machine is here to be understood as a measurement which corresponds approximately to the distance between the points of the side feet 3, 4 lying radially furthest apart from one another and transverse to a length L. The length L is measured for example in the direction of a longitudinal axis 26 which runs through a vertical central plane of the main foot containing the central axis 8 and is in the embodiment greater than the width B. Other measures can be denoted the "width" of the circular knitting machine, depending on the situation.

According to FIGS. 1 and 2 the side foot 3 has a first bottom brace 27 at its lower end, an intermediate part 28 at its upper end and an upright 29 between these two, wherein both the bottom brace 27 and the intermediate part 28 are aligned substantially radially and horizontally in the assembled state, whereas the upright 29 is arranged substantially vertically. The intermediate part 28 and the bottom brace 27 are fixed at their radially inner ends to the upper and lower support rings 5 and 9 respectively by means of screws 23, 24 and at their radially outer ends to the upper and lower ends of the upright 29 by means of further screws 30, 31. The compensating elements 25 preferably are fixed rotatably below the upright on the bottom brace 27 by means of threaded parts, for which the upright 29 and/or the bottom brace 27 can be provided with corresponding threaded parts, and the elements 25 can be so adjusted by rotating them that the circular knitting machine is levelled precisely in normal operation. Moreover FIGS. 1 and 4 in particular show that the bottom brace 27 is provided at its radially outer end with a step 27*a* for supporting the upright 29.

According to a preferred embodiment of the invention the side foot 4 is formed just like the side foot 3. In contrast the main foot 2 is preferably formed in the manner of a control cabinet, in order to be able to fit the various assemblies and operating elements therein. Moreover FIG. 2 in particular shows that all three feet 2, 3 and 4 extend radially out so far beyond the other parts of the circular knitting machine that a conceptual enveloping circle only touches the outer tips of the feet 2, 3 and 4 and within this enveloping circle protective gratings, doors and the like, not shown, can be releasably fitted in the side surface of the feet 2, 3 and 4. These are mounted between the upper and lower support rings 5, 9 in known manner during operation of the machine, in order to prevent inadvertent injuries to the operating personnel from the rotating take-down and/or winding-up device 14 or other rotating parts. The dimensions B and L in FIG. 2 are therefore determined by the radial spacings of the feet 2, 3 and 4 or their uprights 29 from the central axis 8.

Figure 4:
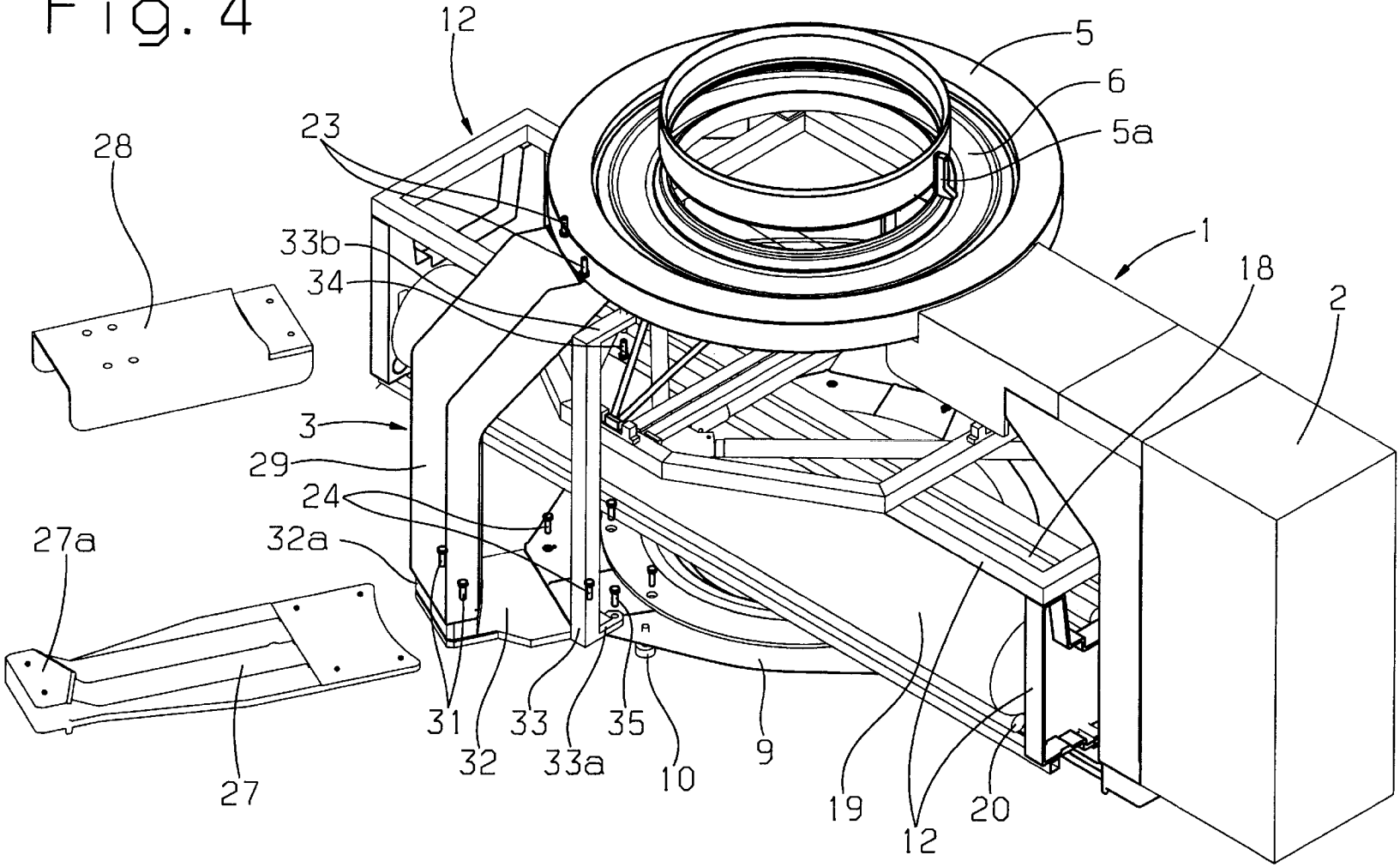
FIG. 4 is a view of the circular knitting machine corresponding to FIG. 1 in a transport state, with two components removable for its manufacture.
Figure 5:
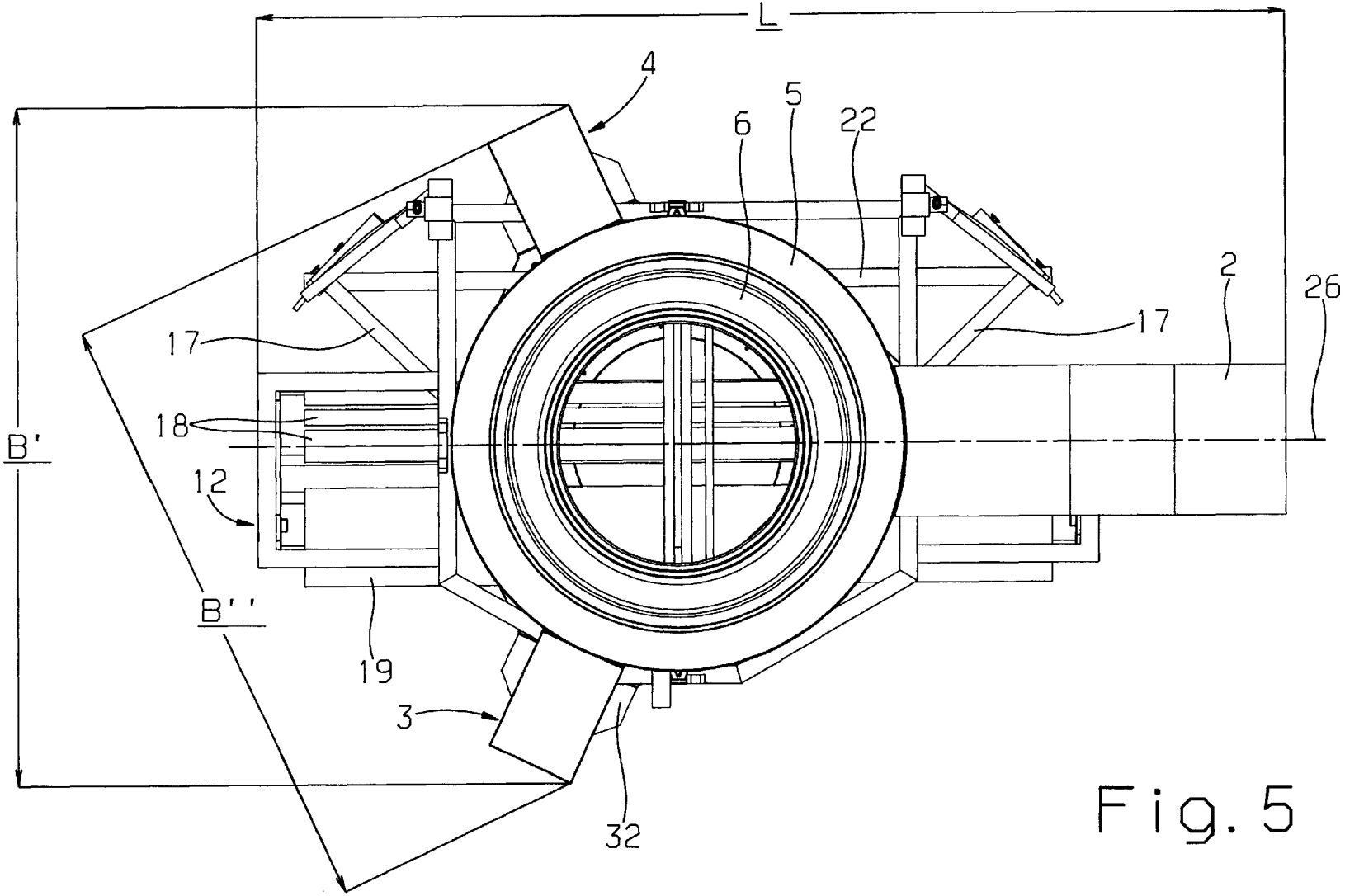
FIG. 5 is a plan view of the circular knitting machine according to FIG. 4.

An alteration of the width B can be effected according to the invention in that on the one hand two bottom braces 27 and 32 for the foot 3 of different lengths are associated with the frame 1 (FIG. 4), so that this foot can be connected to the lower part of the frame 12 selectively by means of the first bottom brace 27 or by means of the second bottom brace 32. On the other hand the upright 29 and the intermediate part 28 are so designed that the foot 3 be fixed at the upper end selectively by means of the intermediate part 28 or directly on the upper part of the frame 1. FIGS. 1 and 2 show the fixing by means of the intermediate part 28 and the first, long bottom brace 27 and FIGS. 4 and 5 show the fixing without the intermediate part 28 and with the second, short bottom brace 32. It is particularly advantageous if the second bottom brace 32 is also so formed that it can be fixed with the same screws 24, 31 as the first bottom brace 27 to the lower support ring 9 and the lower end of the upright 29. The second bottom brace 32 is moreover provided at its radially outer end with a step 32*a* corresponding to the step 27*a*. Finally, the upper end of the upright 29 is preferably formed just like the radially inner end of the intermediate part 28, so that it can, when the intermediate part 28 is omitted, be fixed in the same manner as this by means of the screws 23 to the upper support ring 5, as FIGS. 1 and 4 show. Moreover the relative lengths of the intermediate part 28 and the bottom braces 27, 32 are so selected that the upright 29 of the foot 3 assumes substantially the same vertical position both in the arrangement according to FIGS. 1 and 2 and in that according to FIGS. 4 and 5.

Finally, an auxiliary upright 33 (FIG. 4) is associated according to the invention with the frame 1 and preferably has at its ends two arms 33*a*, 33*b* bent over at 90?. The spacing of the outer surfaces of the two arms 33*a*, 33*b* is somewhat smaller than the clear distance of the upper support ring 5 from the lower support ring 9. It is therefore possible to insert the two arms 33*a*, 33*b* from the outside radially into a gap between the support rings 5, 9 and then fix it to the frame 1. To this end the arm 33*a* has a screw hole, with which is associated a threaded bore in the lower support ring 9, while the arm 33*b* has a threaded bore, with an adjusting and clamping screw 34 fitted therein. It is then possible firstly to bring the auxiliary support 33 into the position seen in FIG. 4, then to fix it to the lower support ring 9 by means of a fixing screw 35 screwed through the screw hole of the arm 33*a* into the threaded bore of the lower support ring, and then to clamp it between the lower side of the upper support ring 5 and the upper side of the lower support ring 9 by tightening up the adjusting screw 34. The arrangement is advantageously such that the auxiliary upright 22 can be positioned and fixed in the peripheral direction of the support rings 5, 9 immediately where the foot 3 is located.

The side foot 4 is preferably, but not essentially, formed just the same as the side foot 3 and is radially adjustable with an intermediate part 28, two bottom braces 27 and 32 and an associated auxiliary foot 33.

Changing the machine width (dimension B in FIG. 2) from a transport position shown in FIGS. 4 and 5 into an operating position seen in FIGS. 1 to 3 can, if necessary after taking off protective gratings or the like, not shown, be effected as follows for example:

The auxiliary feet 10 arranged in the region of the feet 3 and 4 are firstly screwed out so far that the lower support ring 9 is firmly supported on them. Then the auxiliary upright 33 is put in position and clamped firmly between the upper and lower support rings 5, 9 by means of the screws 34 and 35, so that these rings are now fixed with the aid of the upright 33 and held at their spacing. The screws 24, 31 on the lower support ring 9 and on the lower end of the upright 29 are then slackened and unscrewed, whereafter the short bottom brace 32 is removed and replaced by the long bottom brace 27, which is then fixed by means of the screws 24 to the lower support ring 9. The upper support ring 5 is supported on the lower support ring 9 during this time by means of the auxiliary upright 33, so that the frame 1 cannot distort.

A balk of timber is then preferably placed on the bottom brace 27 and below the underside of the upright 29, specifically at a place between the step 27*a* and the lower support ring 9. The screws 23 on the upper support ring 5 are then slackened and undone, so that the upright 29 comes to lie on the timber balk and is advantageous held there by an assistant. It is now possible to pull the upright 29 on the timber balk radially outwards into its operating position seen in FIG. 1, which is determined by the position of the step 27*a* and the screw holes formed therein. The upright 29 is then fixed at its lower end on the bottom brace 27 by means of the screws 31.

The intermediate part 28 is finally placed in the manner shown in FIGS. 1 and 4 on the upper end of the upright 29 and the upper support ring 5 and fixed at one end to the upper support ring 5 by means of the screws 23 and at the other end to the upright 29 by means of the screws 30. The foot 3 is now in its operating position.

If the second foot 4 is also in a transport position according to FIGS. 4 and 5, it is brought into the operating position in the same way, as described above for the foot 3.

After tightening up all screws the frame 1 is levelled by means of the adjusting elements 25, whereafter on the one hand the auxiliary upright 33 is removed, on the other hand the auxiliary feet 10 can be screwed in again, so that the frame 1 and the whole circular knitting machine therewith is now supported solely on the feet 2 to 4. The auxiliary feet 10 can naturally also be used as additional supports for the lower support ring 9.

As a comparison of FIGS. 2 and 5 shows, the dimension B' in FIG. 5 obtained in the transport position of the feet 3, 4 is markedly smaller than the dimension B in FIG. 2 in the operating position of the feet 3, 4. If the circular knitting machine set up in accordance with FIGS. 1 to 3 is to be moved to another place for any reason and be given a width which is, for transport reasons, smaller than the dimension B, it is merely necessary for the one and/or the other of the side feet 3, 4 to be brought into the transport position shown in FIG. 5, in that the steps explained above are performed in the reverse order. It will be understood that the minimum machine width does not necessarily have to correspond to the dimension B' in FIG. 5 perpendicular to the longitudinal direction 26. Rather, depending on the number and position of the feet 2, 3 and 4 the minimum width in the arrangement of the feet 3, 4 in the transport position can even be smaller than B', as is indicated in FIG. 5 by a dimension B" transverse to but oblique with respect to the longitudinal axis 26.

A significant advantage of the invention lies in that the feet 2, 3 and 4 can have comparatively large angular spacings of 130° for example between the side feet 3, 4 on the one hand and 115° for example between each of these and the main foot 2 on the other hand—as regarded in the peripheral direction—in the operating position according to FIG. 2. In spite of the ability to reduce the machine width for transport high stability in operation is thereby facilitated.

A further substantial advantage results in that the frame 1 of the circular knitting machine forms a stiff assembly resisting distortion even in the transport position of the feet 3 and 4 (FIGS. 4 and 5), through the auxiliary upright(s) 33, and can therefore be operated even in this state, at least temporarily. It is therefore possible to assemble and set up the circular knitting machine in the factory initially with the aid of the auxiliary uprights 33 and with the feet 3 and 4 in the transport position and to bring the feet 3, 4 into the operating position only after delivery to the customer. However, in this case, instead of the comparatively long take-down and winding-up rollers 18, 19, other, comparatively short take-down and winding-up rollers must be used, with which the knitwear 15 can be taken down and rolled up in a double layer, as hose, without the auxiliary upright 33 impeding this operation. It is also advantageous that the additional parts 32 and 33 which are required are comparatively inexpensive to make.

The invention moreover makes several advantageous options possible. For example it is possible to make the angular spacing of the feet 3, 4 so large in the operating position that the winding-up roller 19 for winding up spread out knitwear 15 can be removed in their operating position without any problem from the frame 1, even in the completely full state, where the axis of the winding-up roller 19 can be arranged perpendicular to the longitudinal axis 26 in FIG. 2. Furthermore the arrangement is preferably made such that the machine width can be altered, even with a take-down and/or winding-up device 14 mounted in the frame 1, especially if the axes of the take-down and/or winding-up rollers 18, 19 are arranged in accordance with FIGS. 4 and 5 substantially parallel to the longitudinal axis 26. Furthermore a take-down and/or winding-up device 14 for spread out knitwear 15 in accordance with FIGS. 1 to 5 or a take-down and/or winding-up device merely for closed hose can be selectively mounted in the frame 1, as is known per se. It would merely be necessary for this, without the guide bars 16, the V-rollers 17 and the guide roller 22 to mount a suitably reduced length take-down and/or winding-up device in the frame 12, which can in this case be arranged in a manner turned through 90° relative to the needle carrier 7 as is also known per se. In the embodiment at least one entraining device 37 is provided for this on the underside of the cylinder support ring 6 and serves for synchronous rotation of the frame 12 with the cylinder support ring 6 and can be trapped selectively in two coupling receptacles 38 spaced by 90° on the frame 12. The arrangement is made such according to the invention that the circular knitting machine is ready for operation with the feet 3, 4 in the transport position, at least with the take-down and/or winding-up device adapted for closed hose. This makes it possible to carry out all work needed to set up the circular knitting machine in the factory in a transport position of the frame 1 requiring comparatively little space and to fit the take-down and/or winding-up device 14 for spread out knitwear 15 only thereafter or even only at the customer's.

The invention is not restricted to the described embodiment, which can be modified in many ways. It would for example be possible to provide more than one intermediate part 28 each and more than two bottom braces 27, 32, for example in order to realise different functions of the circular knitting machine with an optimum width for each. It is clear that the feet can be mounted in the frame in different way from that described and with other means than those described. It would further be possible to make the foot 3 and/or 4 radially adjustable as a whole, in that it is mounted radially slidable in the frame 1 for example or in that the bottom brace 27 and the intermediate part 28 are made from two relatively slidable parts. A further possibility would be that the foot 3 and/or 4 is arranged pivotally, in that it is mounted to turn about a pivotal axis provided parallel to the middle axis 8 (FIG. 1) in the region of the screws 23, 24. The invention can further be used on frames which have more that three feet and if required also an adjustable main foot 2. The invention is furthermore not limited to the described values of diameters and angles, which are only given as examples. The needle carrier 7 could be in the form a dial, instead of a needle cylinder, or include a dial as well as a needle cylinder. Finally it will be understood that the various features can be used in combinations other than those illustrated and described.

What is claimed is:

1. A circular knitting machine with a frame (1) having at least three feet (2, 3, 4), in which are mounted a needle carrier (7) with a central axis (8), a cam box ring surrounding this and a [take-down and/or winding-up] device (14) for taking down and/or winding up a knitwear produced by the needle carrier (7), wherein the feet (2, 3, 4) establish a machine with (B), characterized in that the frame (1) comprises at least one of the feet (2, 3, 4) formed as an adjustable foot (3, 4) for altering the machine width (B).

2. A circular knitting machine according to claim 1, characterized in that the adjustable foot (3, 4) is settable in at least an operating position corresponding to a first machine width (B) and a transport position corresponding to a second machine width (B', B").

3. A circular knitting machine according to claim 1, characterized in that the adjustable foot as a whole is slidable radially relative to the central axis (8) or turnable and fixable in at least two positions.

4. A circular knitting machine according to claim 1, characterized in that the frame (1) has three feet (2, 3, 4), of which two are adjustable for altering the machine width (B).

5. A circular knitting machine according to claim 4, characterized in that one foot (2) is a main foot, while the two adjustable feet (3, 4) form side feet which are arranged at a distance of substantially 115° each from the main foot (2).

6. A circular knitting machine according to claim 1, characterized in that an intermediate part (28) and two bottom braces (27, 32) of different lengths are associated with the frame (1) and the adjustable foot (3, 4) is fixable at an upper end to the upper part of the frame (1) either by directly or by means of the intermediate part (28) and at a lower end to a lower part of the frame (1) either by means of the one or by means of the other bottom brace (27).

7. A circular knitting machine according to claim 6, characterized in that the frame (1) comprises at least an upper and a lower support ring (5, 9) and the adjustable foot (3, 4) fixable at the upper end to the upper support ring (5) either directly or by means of the intermediate part (28) and at the lower end to the lower support ring (5) selectively by means of one of the two bottom braces (27, 32).

8. A circular knitting machine according to claim 1, characterized in that an auxiliary upright (33) is provided for the alteration of the machine width (b).

9. A circular knitting machine according to claim 8, characterized in that the auxiliary upright (33) is clampable between the upper and lower support rings (5, 9).

10. A circular knitting machine according to claim 1, characterized in that the arrangement is such that the machine width (B) is alterable even with a take-down and/or winding-up device (14) mounted in the frame (1).

11. A circular knitting machine according to claim 1, characterized in that the device adapted for a closed hose knitwear or a device (14) adapted for a spread out hose knitwear (15) is mountable selectively in the frame (1).

12. A circular knitting machine according to claim 11, characterized in that the arrangement is such that it is capable of operation even with an adjustable foot/feet (3, 4) in the transport position with the device (14) for closed hose.

* * * * *